United States Patent [19]

Isobe et al.

[11] Patent Number: 4,631,169

[45] Date of Patent: Dec. 23, 1986

[54] ALLOYS FOR EXHAUST VALVES

[75] Inventors: Susumu Isobe; Kenkichi Matsunaga, both of Aichi; Yoshiaki Takagi, Saitama; Norikatsu Sato, Tochigi, all of Japan

[73] Assignees: Daido Tokushuko Kabushiki Kaisha; Honda Giken Kogyo Kabushiki Kaisha, both of Japan

[21] Appl. No.: 719,102

[22] Filed: Apr. 2, 1985

[30] Foreign Application Priority Data

Apr. 3, 1984 [JP] Japan ..... 59-65280

[51] Int. Cl.[4] ..... C22C 19/05

[52] U.S. Cl. ..... 420/443; 420/447

[58] Field of Search ..... 420/443, 447, 448; 148/410, 428

[56] References Cited

U.S. PATENT DOCUMENTS 3,573,901 4/1971 Economy ..... 420/448

*Primary Examiner*—R. Dean

*Attorney, Agent, or Firm*—Sughrue, Mion, Zinn, Macpeak and Seas

[57] ABSTRACT

An alloy for use in exhaust valves is disclosed, which consists by weight percentage of 0.01~0.15% of C, not more than 2.0% of Si, not more than 2.5% of Mn, 53~65% of Ni, 15~25% of Cr, 0.3~3.0% of Nb, 2.0~3.5% of Ti, 0.2~1.5% of Al, 0.0010~0.020% of B, and the remainder being substantially Fe. If necessary, the alloy further contains at least one element selected from 0.001~0.030% of Mg, 0.001~0.030% of Ca and 0.001~0.050% of REM.

2 Claims, No Drawings

ALLOYS FOR EXHAUST VALVES

BACKGROUND OF THE INVENTION (1) Field of the Invention

This invention relates to an alloy for use in exhaust valves of various internal combustion engines.

(2) Description of the Prior Art

Heretofore, high-manganese austenite steel, SUH36 (Fe-8.5%Mn-21%Cr-4%Ni-0.5%C-0.4%N), has largely been used as an exhaust valve material for gasoline engines and diesel engines.

Lately, the trend to increasing the compression ratio and the output of engines has increased, and hence the service conditions of engine valves have become more severe.

According to the above, there are used Ni-based heat resistant alloys having excellent high-temperature strength and corrosion resistance such as NCF 751 (Ni-15.5%Cr-1%Nb-2.3%Ti-1.2%Al-7%Fe) and NCF 80A (Ni-19.5%Cr-2.5%Ti-1.4%Al).

However, these Ni-based heat resistant alloys contain a great amount of expensive nickel, so that the cost of a valve made therefrom is raised considerably.

Therefore, it is strong demand has arisen to develop valve materials durable under severe service conditions and cheap in cost. For this purpose, the inventors previously proposed Fe-Ni based heat resistant alloys (Japanese Patent Application No. 58-154504).

SUMMARY OF THE INVENTION

The inventors have made further studies with respect to the influence of alloying elements on high-temperature properties in order to provide cheap valve materials durable under sever service conditions and found that alloys for use in valve materials having a chemical composition as mentioned later considerably improve the resistance to attack of lead oxide (PbO), which is an important property required for a valve material, and they have substantially the same properties as the above Fe based heat resistant alloys.

DETAILED DESCRIPTION OF THE INVENTION

The alloy for use in exhaust valves according to the invention is characterized by consisting by weight percentage of 0.01~0.15% of carbon, not more than 2.0% of silicon, not more than 2.5% of manganese, 53~65% of nickel, 15~25% of chromium, 0.3~3.0% of niobium, 2.0~3.5% of titanium, 0.2~1.5% of aluminum, 0.0010~0.020% of boron, and if necessary at least one of 0.001~0.030% of magnesium, 0.001~0.030% of calcium and 0.001~0.050% of a rare earth element (hereinafter abbreviated as REM), and the remainder being substantially iron.

According to the invention, the reason for limiting the chemical composition of the alloy to the ranges (by weight percentage) as mentioned above is as follows:

Carbon (C): 0.01~0.15%

Carbon is an effective element for bonding with Cr, Nb or Ti to form a carbide and enhance high-temperature strength. In order to provide such an effect, it is necessary to add carbon in an amount of at least 0.01%. However, when the amount is too large, the high-temperature strength, toughness and ductility lower, so that the amount of C is limited to not more than 0.15%.

Silicon (Si): not more than 2.0%

Silicon is necessary as a deoxidizing element. When the amount of Si is too large, not only are the strength, toughness and ductility degraded but also the resistance to the attack of PbO is degraded, so that the amount of Si is limited to not more than 2.0%.

Manganese (Mn): not more than 2.5%

Manganese acts as a deoxidizing element like Si. When the amount of Mn is too large, the oxidation resistance at high temperature lowers, so that the amount of Mn is limited to not more than 2.5%.

Nickel (Ni): 53~65%

Nickel is required for stabilizing austenite and provide high-temperature strength by precipitation of a $\gamma'$-phase $\{Ni_3(Al, Ti, Nb)\}$ through aging treatment. Further, Ni is important as an element enhancing the resistance to the attack of PbO. When the amount of Ni is less than 53%, the resistance to the attack of PbO is insufficient, so that the addition of not less than 53% is necessary. However, when the amount of Ni is too large, the material cost increases and also Ni is apt to be attacked by S if the valve is used in an atmosphere containing sulfur (S), so that the Ni amount is limited to not more than 65%.

Chromium (Cr): 15~25%

Chromium is an element necessary for maintaining the acid resistance and corrosion resistance at high temperature. For this purpose, it is required to be 15% at minimum. When the amount of Cr is too large, an austenite phase becomes unstable and brittle phases such as an $\alpha$-phase, $\sigma$-phase and the like are precipitated to degrade high temperature strength, toughness and ductility so that the Cr amount is limited to not more than 25%.

Niobium (Nb): 0.3~3.0%

Niobium is an element effective for enhancing high temperature strength by the formation of a carbide or $\gamma'$-phase. In order to provide such an effect, it is necessary to add Nb in an amount of at least 0.3%. When the addition amount is too large an, $\delta$-phase ($Ni_3Nb$) and a Laves phase ($Fe_2Nb$) are precipitated to degrade not only high-temperature strength, toughness and ductility but also acid resistance and corrosion resistance. Therefore, the upper limit is 3.0%.

Titanium (Ti): 2.0~3.5%

Titanium is an element mainly forming an $\gamma'$-phase and is important for maintaining high temperature strength. When the Ti amount is too small, the precipitating amount of the $\gamma'$-phase is less and high temperature strength is not obtained sufficiently, while when it is too large, an $\eta$-phase ($Ni_3Ti$) is precipitated to reduce the strength. Therefore, the Ti amount is limited to a range of 2.0~3.5%.

Aluminum (Al): 0.2~1.5%

Aluminum is an element mainly forming an $\gamma'$-phase like Ti and Nb. However, when the Al amount is too small, the $\gamma'$-phase becomes unstable and an $\eta$-phase is precipitated to decrease strength. In order to prevent the precipitation of the $\eta$-phase, it is necessary to add Al in an amount of not less than 0.2%.

On the other hand, when the Al amount is too large, the alignment between the $\gamma'$-phase and the matrix is enhanced to reduce the aligning strain and the sufficient strength can not be obtained in a short time. Furthermore, excessive addition of Al considerably reduces the productivity. From these facts, the upper limit is 1.5%.

Boron (B): 0.0010~0.020%

Boron acts not only to enhance the creep strength by segregation into the crystal grain boundaries but also to suppress the precipitation of the $\eta$-phase into the crystal grain boundaries. In order to provide such an action, it is necessary to add B in an amount of not less than 0.0010%. However, when the amount of B is too large, the hot workability is extremely deteriorated, so that the upper limit is 0.020%.

At least one element selected from magnesium (Mg): 0.001~0.030%, calcium (Ca): 0.001~0.030%, and a rare earth element (REM): 0.001~0.050%

All of these elements act as a deoxidation and desulfurization element in melting and serve to fix the remaining sulfur (S) as sulfide to considerably improve hot workability. Further, they have an effect of simultaneously improving the creep rupture strength and elongation at breakage, and also, REM serves to improve oxidation resistance. However, when the amounts of these elemenets are too large, the hot workability is considerably deteriorated. Therefore, the amounts of Mg, Ca and REM are limited to 0.001~0.030%, 0.001~0.030% and 0.001~0.050%, respectively.

EXAMPLE

The properties of a Fe-Ni based alloy for use in exhaust valves according to the invention will concretely be described with reference to the following examples together with comparative examples.

An alloy having a chemical composition as shown in the following Table 1 was melted in a high frequency vacuum induction furnace and then cast into an ingot of 30 kg.

TABLE 1

| No. | Chemical composition (% by weight) C | Ni | Cr | Nb | Ti | Al | B | Mg, Ca, REM | Fe |
|---|---|---|---|---|---|---|---|---|---|
| Example | | | | | | | | | |
| 1 | 0.06 | 55.09 | 18.13 | 0.89 | 2.50 | 0.88 | 0.004 | — | remainder |
| 2 | 0.05 | 55.17 | 24.20 | 0.87 | 2.54 | 0.90 | 0.004 | — | remainder |
| 3 | 0.05 | 60.40 | 21.59 | 0.90 | 2.73 | 0.85 | 0.004 | — | remainder |
| 4 | 0.05 | 64.32 | 18.54 | 0.85 | 2.61 | 0.83 | 0.004 | — | remainder |
| 5 | 0.06 | 60.35 | 18.88 | 2.03 | 2.42 | 0.83 | 0.004 | — | remainder |
| 6 | 0.05 | 60.24 | 18.29 | 0.64 | 3.07 | 0.74 | 0.005 | — | remainder |
| 7 | 0.04 | 60.03 | 18.17 | 0.92 | 2.49 | 1.05 | 0.004 | — | remainder |
| 8 | 0.05 | 59.87 | 21.42 | 0.87 | 2.68 | 0.80 | 0.004 | Mg 0.0063 | remainder |
| 9 | 0.05 | 60.01 | 21.48 | 0.85 | 2.65 | 0.81 | 0.004 | Ca 0.0092 | ramainder |
| 10 | 0.04 | 60.16 | 21.13 | 0.91 | 2.60 | 0.87 | 0.005 | REM 0.0195 | remainder |
| Comparative Example | | | | | | | | | |
| 11 | 0.06 | 50.11 | 20.84 | 1.01 | 2.65 | 0.70 | 0.005 | — | remainder |
| 12 | 0.05 | 60.48 | 18.57 | — | 2.92 | 0.86 | 0.004 | — | remainder |
| 13 | 0.05 | 59.87 | 18.13 | 0.86 | 1.83 | 0.90 | 0.005 | — | remainder |
| 14 | 0.05 | remainder | 15.52 | 0.94 | 2.31 | 1.28 | — | — | 7.02 |

Ramarks
(Note)
1. Each of Si and Mn in the specimen is within a range of 0.15~0.30%.
2. The specimen No. 14 corresponds to Inconel 751 (trade name).

The ingot was then subjected to a soaking treatment at 1150° C. for 16 hours, from which a specimen was taken out. This specimen was subjected to a high speed and high temperature tensile test to examine hot workability. Further, a part of the soaked ingot was forged and rolled at a temperature of 1150°~950° C. into a rod of 16 mm in diameter, which was used as a specimen for the evaluation of high temperature tensile properties and corrosion resistance. Moreover, the latter specimen for the evaluation of high temperature tensile properties and corrosion resistance was subjected to a solid solution treatment (heating at 1050° C. for 30 minutes→oil cooling) and an ageing treatment (heating at 750° C. for 4 hours→air cooling).

(1) High temperature tensile properties

Since an engine valve is subjected to repeated impact by a reaction force of a valve spring during operation, the valve material is required to have excellent tensile properties at a temperature near the operating temperature.

In the following Table 2 are shown tensile test results of the alloys according to the invention (Nos. 1~7) and the comparative alloys (Nos. 11~14) at 800° C.

TABLE 2

| No. | 0.2% proof strength kgf/mm² | tensile strength kgf/mm² | elongation % | reduction ratio % |
|---|---|---|---|---|
| Example | | | | |
| 1 | 50.7 | 65.3 | 7.2 | 11.6 |
| 2 | 50.5 | 66.1 | 6.1 | 11.0 |
| 3 | 51.0 | 65.8 | 6.6 | 10.8 |
| 4 | 51.4 | 65.6 | 5.8 | 11.3 |
| 5 | 52.4 | 66.4 | 5.6 | 10.2 |
| 6 | 51.2 | 65.6 | 5.6 | 12.4 |
| 7 | 50.2 | 64.4 | 7.0 | 12.6 |
| Comparative Example | | | | |
| 11 | 49.5 | 65.8 | 6.1 | 12.4 |
| 12 | 42.4 | 58.6 | 7.5 | 11.6 |
| 13 | 41.0 | 53.2 | 8.0 | 12.4 |
| 14 | 51.4 | 66.3 | 6.5 | 10.4 |

As shown in Table 2, the 0.2% proof strength and tensile strength at 800° C. in the alloys according to the invention (Nos. 1~7) are substantially equal to those of the existing Ni-based heat resistant alloy (No. 14) (corresponding to Inconel 751). Further, the strength of the alloy according to the invention is superior to those of the comparative alloy (No. 12) containing no Nb and the comparative alloy (No. 13) containing a small amount of Ti.

(2) High temperature corrosion resistance

A gasoline containing tetraethyl lead [$(C_2H_5)_4Pb$] for increasing the octane value may be used as a fuel. In the case of such a leaded gasoline, lead oxide (PbO) may be produced by combustion, which adheres to the valve surface to cause high temperature corrosion (PbO attack). For this reason, the resistance to PbO attack is an important property in a valve material.

A corrosion test in PbO (920° C.×1 hour) was made with respect to the alloys according to the invention. The thus obtained results are shown in the following Table 3.

TABLE 3

| No. | Example 1 | 2 | 3 | 4 | 5 | 6 | 7 | Comparative Example 11 | 12 | 13 | 14 |
|---|---|---|---|---|---|---|---|---|---|---|---|
| corrosion loss ($mg/cm^2$) | 21.6 | 20.5 | 13.2 | 11.3 | 14.0 | 13.7 | 13.5 | 580 | 12.9 | 13.8 | 11.2 |

As shown in Table 3, the resistance of PbO attack in the alloys according to the invention is substantially equal to that of the existing Ni-based heat resistant alloy (No. 14).

On the other hand, the corrosion loss of the comparative alloy (No. 11) is considerably large, which results from the fact that the Ni content effective for obtaining the desired resistance to PbO attack is small.

When engine oil is burnt together with gasoline, the combustion product adhered to the valve surface is less as a pure PbO and is frequently existent as a mixture of PbO and lead sulfate ($PbSO_4$). When PbO and $PbSO_4$ are coexistent, corrosion occurs more violently.

Then, a corrosion test in a mixed ash of PbO and $PbSO_4$ ($PbO:PbSO_4=6:4$) (920° C.×1 hour) was also made with respect to the alloys according to the invention. The thus obtained results are shown in the following Table 4.

TABLE 4

| No. | Example 1 | 2 | 3 | 4 | 5 | 6 | 7 | Comparative Example 11 | 12 | 13 | 14 |
|---|---|---|---|---|---|---|---|---|---|---|---|
| corrosion loss ($mg/cm^2$) | 412 | 410 | 425 | 537 | 516 | 455 | 468 | 321 | 446 | 472 | 678 |

As shown in Table 4, the resistance to $PbO+PbSO_4$ attack in the alloys according to the invention is excellent as compared with that of the existing Ni-based heat resistant alloy (No. 14). This results from the fact that when $SO_4^{-2}$ is existent, the corrosion resistance lowers as the Ni content in the alloy becomes higher. According to the invention, therefore, the range of the Ni content (53~65%) was restricted by considering both resistance to PbO attack and resistance to $PbO+PbSO_4$ attack.

(3) Hot workability

In general, it is said that the temperature region for obtaining a reduction ratio of not less than 50% is the rollable range of an alloy in high temperature and high speed tensile test using a Gleeble testing machine. Therefore, it can be judged that the hot workability becomes excellent as the above temperature region is wider. The above test was made with respect to the alloys No. 3 and 8–10 according to the invention to measure the temperature region. The measured results are shown in the following Table 5.

TABLE 5

| No. | Temperature region for obtaining reduction ratio of not less than 50% (°C.) |
|---|---|
| 3 | 170 |
| 8 | 240 |
| 9 | 230 |
| 10 | 230 |

As shown in Table 5, the hot workable temperature region in alloys No. 8~10 containing any one of Mg, Ca and REM is wider than that of alloy No. 3 containing no Mg, Ca and REM, from which it is obvious that the hot workability is largely improved.

As mentioned above, the alloy for use in the exhaust valve according to the invention consists by weight percent of 0.01~0.15% of C, not more than 2.0% of Si, not more than 2.5% of Mn, 53~65% of Ni, 15~25% of Cr, 0.3~3.0% of Nb, 2.0~3.5% of Ti, 0.2~1.5% of Al, 0.0010~0.020% of B, and if necessary at least one element selected from 0.001~0.030% of Mg, 0.001~0.030% of a Ca 0.001~0.050% of REM, and the remainder being substantially Fe, so that it is excellent in high temperature strength and high temperature corrosion resistance, particularly corrosion resistance under a mixed atmosphere of $PbO+PbSO_4$. Further, the content of expensive nickel is smaller than that of the conventional Ni-based heat resistant alloys, which can realize a reduction in cost.

What we claim is:

1. An alloy for use in exhaust valves consisting essentially of, by weight percentage, of 0.01~0.15% of carbon, not more than 2.0% of silicon, not more than 2.5% of manganese, 53~65% of nickel, 15~25% of chromium, 0.3~3.0% of niobium, 2.0~3.5% of titanium, 0.2~1.5% of aluminum, 0.0010~0.020% of boron and the remainder being substantially iron.

2. An alloy for use in exhaust valves consisting essentially of, by weight percentage, of 0.01~0.15% of carbon, not more than 2.0% of silicon, not more than 2.5% of manganese, 53~65% of nickel, 15~25% of chromium, 0.3~3.0% of niobium, 2.0~3.5% of titanium, 0.2~1.5% of aluminum, 0.0010~0.020% of boron, at least one element selected from the group consisting of 0.001~0.030% of magnesium, 0.001~0.030% of calcium and 0.001~0.050% of rare earth element, and the remainder being substantially iron.

* * * * *